US007090761B2

(12) United States Patent
Tanaka et al.

(10) Patent No.: US 7,090,761 B2
(45) Date of Patent: Aug. 15, 2006

(54) METHOD OF PRODUCING METAL FERRULES, AND DEVICE THEREFOR

(75) Inventors: Tetsuo Tanaka, Shinjo (JP); Yoshinari Kohno, 25-1, Shikahama 2-chome, Adachi-ku, Tokyo (JP) 123-0864

(73) Assignees: SMK Corporation, Tokyo (JP); Yoshinari Kohno, Tokyo (JP)

( * ) Notice: Subject to any disclaimer, the term of this patent is extended or adjusted under 35 U.S.C. 154(b) by 129 days.

(21) Appl. No.: 10/169,253

(22) PCT Filed: Dec. 27, 2000 (Under 37 CFR 1.47)

(86) PCT No.: PCT/JP00/09342

§ 371 (c)(1), (2), (4) Date: Dec. 11, 2003

(87) PCT Pub. No.: WO01/48271

PCT Pub. Date: Jul. 5, 2001

(65) Prior Publication Data

US 2004/0222099 A1 Nov. 11, 2004

(30) Foreign Application Priority Data

Dec. 28, 1999 (JP) ..... 11-373354
Dec. 28, 1999 (JP) ..... 11-373665
Dec. 28, 1999 (JP) ..... 11-375242

(51) Int. Cl.
*C25D 1/04* (2006.01)
*C25D 1/00* (2006.01)
*C25D 5/00* (2006.01)

(52) U.S. Cl. ..... 205/76; 205/67; 205/79; 205/137; 205/145; 204/198; 204/199

(58) Field of Classification Search ..... 205/67, 205/76, 79, 137, 138, 148, 170, 181; 204/198, 204/199, 212, 222
See application file for complete search history.

(56) References Cited

U.S. PATENT DOCUMENTS 3,502,550 A * 3/1970 Passal ..... 205/271
3,505,177 A * 4/1970 Chester et al. ..... 205/73
3,715,299 A * 2/1973 Anderson et al. ..... 204/212
4,781,799 A 11/1988 Herbert, Jr. et al.
5,160,421 A 11/1992 Melnyk et al.
6,419,810 B1 * 7/2002 Tanaka et al. ..... 205/73

FOREIGN PATENT DOCUMENTS

JP 56-90995 7/1981
JP 4-311589 11/1992
JP 2000-292651 A 11/1992
JP 11-193485 7/1999
JP 11-193485 * 12/1999

* cited by examiner

*Primary Examiner*—Nam Nguyen
*Assistant Examiner*—Luan V. Van
(74) *Attorney, Agent, or Firm*—Nixon & Vanderhye P.C.

(57) ABSTRACT

A method of producing metal ferrules and an apparatus therefore enable metal ferrules to be produced with high productivity and high dimensional accuracy by arranging a plurality of long-sized core wires. A jig receives a metal to be electroformed and is placed in an electroforming tank, a holding unit in which a plurality of core wire holder for holding core wires are held in circumferential array is installed in the electroforming tank, and the core wire holders and the holding unit are rotatable on their respective axes. It is preferable that the resistivity of the core wires be $5\times10^{-6}$ Ωcm or less. A core wire plated within a thin layer of metal having a resistivity of $5\times10^{-6}$ Ωcm or less may be used. A conductive electric discharge body may be provided on the front end of the core wire.

33 Claims, 10 Drawing Sheets

(a)

(b)

METHOD OF PRODUCING METAL FERRULES, AND DEVICE THEREFOR

This application is the US national phase of international application PCT/JP00/09342 filed 27 Dec. 2000, which designated the US.

TECHNICAL FIELD

The present invention relates to a method for producing metal ferrules and an apparatus for producing metal ferrules in which a metal film is formed on the surface of a core wire by electroforming and the core wire is pulled out of the metal film that has been formed.

BACKGROUND ART

Ferrules are employed as a portion of the structural components of connectors used to join quartz group optical fibers. Optical connectors are designed to accurately align the positions of and connect the cores that are in the center of the optical fibers by passing optical fibers that are around 0.125 mm thick through the ferrules and securing them.

Among the ferrules that are currently in use, there are stainless steel, zirconia and plastic ones, but those made of zirconia make up the largest proportion. In producing ferrules made of zirconia, first, zirconia powder and a resin are mixed together; this is molded into a cylindrical form by means of injection molding, extrusion molding, and the like, the molded item is heated at a temperature of around 500° C.; and the resin component is decomposed and eliminated. The product is then fired at a high temperature of around 1,200° C. After firing, the product is cut to a specified length, a wire shaped diamond grinder is passed through the hole in the center of the cylinder, and precise dimensions related the inside diameter are obtained. This grinding work is carried out by hand and accuracy is demanded. In addition, boring is performed and the ferrule is finished with the polishing of the end surfaces. Furthermore, in order to improve the degree of coaxiality of the inside and the outside diameters, the processing is done using a wire centerless machine. Even though the several processes are carried out in this way, the actual state of affairs is that irregularities are produced in the inner and outside diameters, and the coaxiality and the ferrules are individually inspected and separated according to their dimensions.

High-cost injection molding equipment, extrusion molding equipment, and molds are required for the production of zirconia ferrules. In addition, such problems have been pointed out as the fact that the life of the molding equipment and molds is short, the energy cost is high due to the processing of the zirconia-resin molded items at the high temperatures of 500 to 1,200° C., the center hole must be ground with a wire shaped diamond grinder in order to produce the precise hole dimensions, and the productivity is low because the grinding work is done manually by highly skilled workers.

The present invention is one in which metal ferrules are obtained by electroforming instead of producing ferrules made of zirconia. The manufacture of fine-hole pipe by means of electroforming is already known. For example, in Japanese Patent Application Laid-open No. 11-193485, a method for manufacturing tubes having fine holes is disclosed in which a metal film is formed on the surface of a core material and the core material is removed leaving behind the metal film that has been formed. In addition, in Japanese Patent Application Laid-open No. 56-90995 and Japanese Patent Application Laid-open No. 4-311589, a method for manufacturing fine diameter pipe is disclosed in which metal is electroformed and plated on the outer surface of a core wire that can be dissolved by a chemical and, after it is cut to a specified dimension, the core wire is dissolved with the chemical and removed.

In other words, it is a method for manufacturing pipe having a fine diameter in which, after a wire core is prepared and the core wire is electroconductively processed, metal is electrodeposited around the periphery of the core wire by means of an electroforming operation and, following that, the core wire is removed with an appropriate method. Basically, by using this method, it is possible to produce ferrules for connecting optical fiber.

The diameter of the optical fiber is, in conformance with the standards, 0.125 mm and, consequently, the inside diameter of the ferrule should be around 0.126 mm. The length of the ferrule itself is 12 mm or less and the outside diameter is around 2.5 mm. There are various problems related to the production of this kind of small and fine diameter pipe by electroforming. In particular, there are the problems regarding productivity and dimensional accuracy.

In order to increase the productivity, a method is advocated in which a plurality of comparatively long core wires are used with the electroforming done at the same time and, after it is performed this way, they are cut to a specified length. When long core wires are used and, moreover, a plurality of core wires are electroformed at the same time, the problem of uniformity is especially great. Since a high degree of circularity and coaxiality is demanded of the ferrules, the thickness of the electrodeposition layer must be uniform in the longitudinal direction for each of the core wires and, at the same time, the thicknesses of the electrodeposition layers of the multiple number of core wires must be uniform.

The uniformity problems are thus related to the circularity of the ferrules, that is, the way in which the inside and outside diameters of the ferrules can be made uniform, and the coaxiality thereof, that is, in other words, the way in which the axial centers of the and the outside diameter are aligned.

For example, when a stainless steel round wire having a circular cross-section with a diameter of 0.125 mm is used as the core wire and electroforming is carried out with this connected to the power source as the cathode, as is shown in FIG. 3(*b*), an electroforming with a nonuniform amount of electrodeposition is obtained in which the diameter of the upper part is large and the diameter of the lower part is small. This is because the current density of the stainless steel core wire is high for the portion near the power source, but the current density becomes lower the further the area is from the power source due to the electrical resistance. Since the electrodeposition amount is proportional to the current density, the amount of electrodeposited metal becomes greater the closer the area is to the power source where the current density is high, and the amount of electrodeposited metal becomes less the further the area is from the power source. As a result, the diameter becomes larger the closer the area is to the power source, where the current density is high, and the diameter becomes smaller the further the area is from the power source.

The phenomenon of the nonuniformity of the electroforming diameter, where the outside diameter of one end of the casting becomes large and the outside diameter becomes smaller as the other end is approached, is a large problem in those cases where items small in size, such as ferrules used for optical fiber, are produced. In particular, it is a problem when a method is employed as a means to increase the ferrule productivity in which a long length of pipe is produced, and that is cut into specified lengths.

In addition, in those cases where metal balls are used as the anode, the metal balls are inserted into an electroconductive netlike tube or the like. When the core wire is electroformed, the shape of the electroforming is largely dependant upon the shape of the tube into which the metal balls have been inserted. For example, in those cases where the shape of the tube is one that bulges outward, the outside diameter of the casting becomes larger in the area that corresponds to that position and, in those cases where the outside of the tube is indented inward, the outside diameter of the corresponding portion of the casting becomes smaller.

In other words, as is shown in FIG. 13(*a*), the metal lumps 64 of nickel are accommodated in the metal tube 61 made of titanium. The metal tube 61 becomes narrow toward the inside in the middle area. When this metal tube 61 is employed and electroforming is carried out, the resulting casting becomes unacceptably narrow in the area that corresponds to the portion in which the metal tube is indented inward, as shown in FIG. 13(*b*).

Another drawback is that the factors that cause the dimensions of the electroforming to become nonuniform are dependant upon the degree of extensibility of the core wire. In other words, when the tension that is applied to the core wire is great, the core wire is stretched in the longitudinal direction and differences are produced in the diameter of the core wire. Together with this, differences are also produced in the outside diameter of the resulting casting, making it impossible to obtain a ferrule that is uniform and has a high degree of dimensional accuracy. In addition, when the tension is low, slackness is produced in the core wire, and this factor impairs the uniformity of the resulting casting in the same manner.

The present invention provides a method and an apparatus with which ferrules having a small inside diameter, uniform inside and outside diameters, and a high degree of coaxiality are produced with good efficiency and high productivity, particularly when small ferrules having an inside diameter of around 0.126 mm are produced by electroforming.

DISCLOSURE OF THE INVENTION

The present invention presents a method of producing metal ferrules and an apparatus for producing metal ferrules. The production method of the present invention is a method of producing metal ferrules by electroforming a metal film on the outer surface of a core wire and pulling the core wire out of the film electroformed thereon, and this method of producing metal ferrules is characterized by providing a holding unit for holding a plurality of core wire holders each of which holds a core wire and which are arranged circumferentially on the holding unit, providing a plurality of jigs which accommodate the metal used for electroforming in the periphery of the holding unit, and performing electroforming while rotating the core wire holders simultaneously with rotating the holding unit. In addition, it is preferable that the core wire that is used for the electroforming has a resistivity of $5\times10^{-6}$ Ωcm or less. It is also possible to plate a core wire made of stainless steel or phosphor bronze with a thin layer of a first metal having a resistivity of $5\times10^{-6}$ Ωcm or less and to electroform a second metal onto the plated core to a specified diameter. The first metal may be gold, silver, copper, aluminum, an alloy having these as a primary component. For the second metal layer, nickel or an alloy having nickel as a primary component may be used.

A conductive electric discharge body can be provided at one end of the core wire which is further from the power source than the other end of the core wire. In addition, it is preferable that the discharge body have a resistivity of $10\times10^{-6}$ Ωcm or less. It is also preferable that the surface area of the discharge body be 10 to 100 times an outer surface area of the core wire.

In addition, when the metal ferrule is produced by electroforming, a stainless steel or phosphor bronze core wire may be used and nickel or an alloy having nickel as the primary component may be used as the metal for electroforming.

The jigs for accommodating the metal used for the electroforming may be provided with a metal plate having a fixed width nearly over the entire length of said jig and extending in the longitudinal direction of the jig such that the metal plate protrudes perpendicularly from the side of the jig toward the core wire. It is preferable that the metal jig be a netlike tube made of titanium.

The core wire holder may be provided with an elastic mechanism such as a spring or rubber for applying tension to the core wire. It is preferable that the tensioning force imparted to the core wire by the elastic mechanism be less than the elastic limit of the core wire.

In addition, the core wire holder may be provided with wide braces which project outward from the holding unit. Also, it is preferable that the braces be arranged in a radial pattern and that the shape of the braces be rectangular. It is preferable that the number of braces be two to four.

The apparatus for producing metal ferrules of the present invention is a metal ferrule manufacturing apparatus characterized in that a holding unit having a plurality of core wire holders each of which holds a core wire and which are arranged circumferentially on the holding unit is provided; and a plurality of jigs that accommodate the metal to be electroformed is provided in the periphery of the holding unit, wherein while the core wire holders are rotated, the holding unit is rotated at the same time.

In this apparatus, the jigs into which the metal to be electroformed is inserted are arranged circumferentially on the periphery of the core wire holders, the electroforming tank is provided with an ultrasonic generator with which the electroforming solution is agitated, and a conductive electric discharge body can be provided at one end of the core wire which is further from the power source than the other end of the core wire. It is preferable that the resistivity of the conductive electric discharge device be $10\times10^{-6}$ Ωcm or less, and it is also preferable that a surface area of the conductive electric discharge device be 10 to 100 times an outer surface area of the core wire. In addition, the resistivity of the core wire should be $5\times10^{-6}$ Ωcm or less, and it is preferable that the core wire be one that has a covering of a thin metal film with a resistivity of $5\times10^{-6}$ Ωcm or less.

The jigs for accommodating the metal to be electroplated may be provided with a metal plate having a fixed width nearly over an entire length of the jig and extending in the longitudinal direction of the jig such that the metal plate protrudes perpendicularly from a side of the jig facing toward the core wire. It is preferable that the metal jig be a netlike tube made of titanium.

The core wire holder may be provided with an elastic mechanism such as a spring or rubber for applying tension to the core wire. It is preferable that the tensioning force imparted to the core wire by the elastic mechanism be less than the elastic limit of the core wire.

In addition, the core wire holder may be provided with wide braces which project outward from the holding unit.

Also, it is preferable that the braces be arranged in a radial pattern and that the shape of the braces be rectangular. It is preferable that the number of braces be two to four.

BEST MODE FOR CARRYING OUT THE INVENTION

Figure 1:
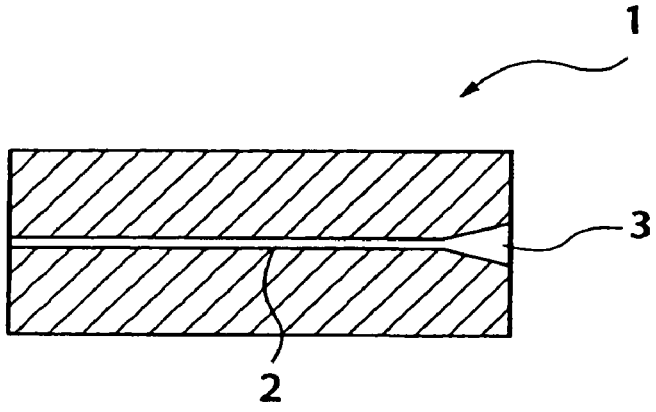
FIG. 1 is a drawing that shows an example of a ferrule.

Since a ferrule is an extremely small item having a length at the most of around 12 mm and an outside diameter of 2.5 mm at best, increasing ferrule productivity is a serious practical problem. Because of this, a method is advocated in which a plurality of comparatively long core wires is concurrently electroformed and are then cut to a specified length.

When long core wires are used and a plurality of core wires is electroformed at the same time, the problem of uniformity is especially great. Since a high degree of circularity and coaxiality is demanded of the ferrules, the thickness of the electrodeposition layer must be uniform in the longitudinal direction for each of the core wires and, at the same time, the thicknesses of the electrodeposition layers of the multiple number of core wires must be uniform.

In order to produce a long electroforming having superior circularity and coaxiality and a high degree of uniformity, one of the things that is important is to make the concentration of ions in the vicinity of the core wire and the anode uniform throughout the electroforming tank.

Stirring is done at the time of the electroforming operation, and the main point of the stirring is to make the ion concentration uniform in the vicinity of the electrodes. The metal ions in the electroforming tank are carried to the vicinity of the cathode by convection or the like and are moved to the surface of the cathode by the diffusion caused by the difference between the metal ion concentration on the cathode surface and the metal ion concentration in the electroforming tank. The metal ions that have moved to the cathode surface lose their electric charge at the cathode surface to conglomerate into metallic crystals. An electric double layer is formed in the vicinity of the cathode, producing a gradient in the metal ion concentration. This difference in metal ion concentration runs in the longitudinal direction of the core wire, and it is necessary to minimize this difference, to reduce the thickness of the diffusion layer, and make it so that the electrodeposition of the metal layer is uniform along the length of the core wire.

In the present invention, in order to make the difference in the metal ion concentrations small, the core wires, which form the cathodes, are rotated individually with their holders and, together with this, the holding unit that holds the plurality of core wire holders is also rotated. Since the diameter of the wire is, at around 0.126 mm, extraordinarily small, the core wires are set into the holders and immersed in the electroforming tank. Consequently, in order to carry out the electroforming of a plurality of core wires at the same time, all of the individual core wires are set in the core wire holder holding unit together with their holders. By turning the core wire holder holding unit at the same time as the individual core wires are rotated with their holders, the ion concentration in the vicinity of the core wires is made uniform. The rotation rate of the core wire holders may be 30 to 100 rpm. In addition, a rotation rate for the core wire holder holding unit of 20 to 80 rpm is preferred.

In addition, as was discussed before, since a diffusion layer known as an electric double layer is produced in the vicinity of the cathode, another key question regarding the stirring is how to make this diffusion layer small. Ultrasound has been ascertained to be particularly effective in making the diffusion layer small. For the wavelength of the ultrasound used, a range of 15 kHz to 60 kHz is preferred, and for its energy, a strength of 2 to 4 $W/cm^2$ is preferred. When ultrasound that possesses characteristics in both of these ranges is used, the effectiveness of the agitation becomes greater. The frequency should be set within this range because the effect of applying the ultrasound waves becomes lower if the wavelength of the ultrasound is less than 15 kHz, and the effect is reduced in the same manner if the wavelength is, conversely, greater than 60 kHz. In addition, the above-mentioned energy range is used because there is no effect if too little energy is applied, and the electroformed product has undesirable wrinkles if the energy is excessive.

Figure 2:
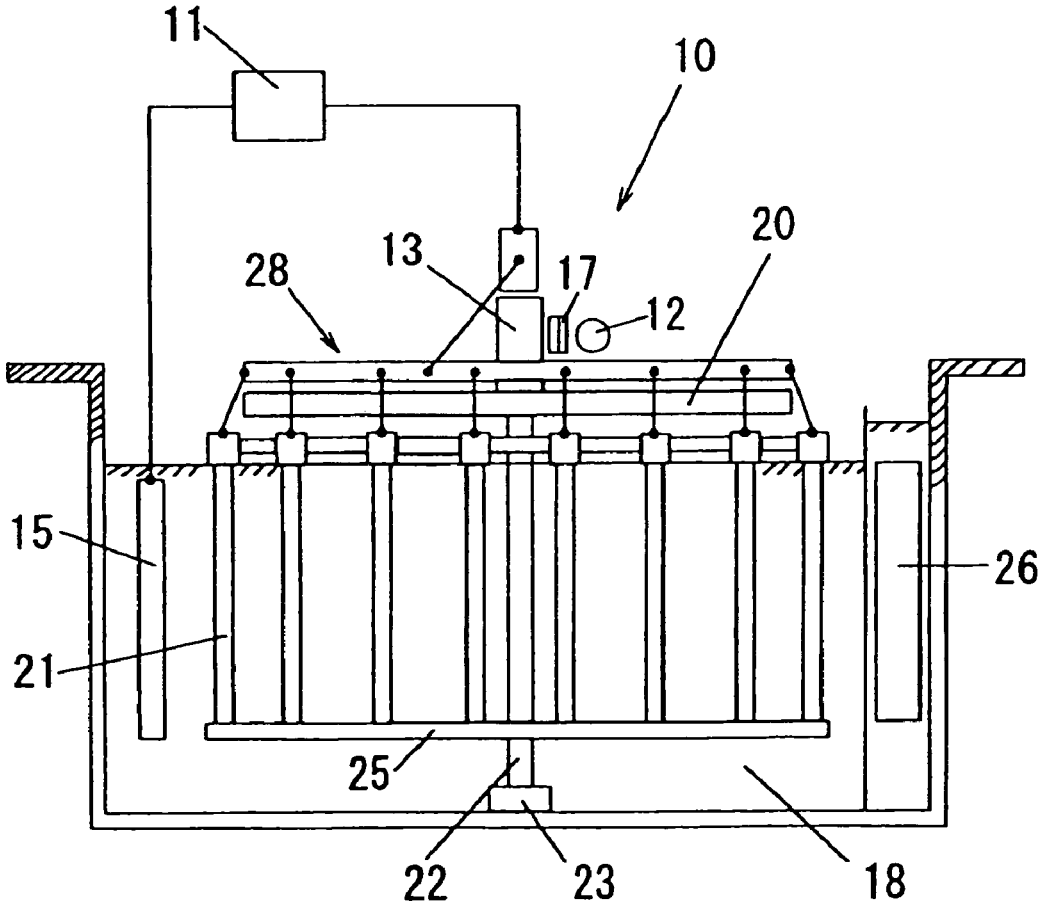
FIG. 2 is a drawing that shows an example of the electroforming device of the present invention.

The electroforming system is as shown in FIG. 2. The electroforming system 10 includes anodes and cathodes. The anode 15 is the metal for electrodepositing, and may consist of a metal plate, metal balls, or the like. In those cases where metal balls are employed, the metal balls can be placed inside an electroconductive bag or the like. A plurality of anodes can be disposed as required. The anode is connected to a power source 11 such as the anode of a battery. The cathodes are core wires 16 to be electroformed. These cathodes are connected to the power source 11, for example, the cathode of a battery. The core wires 16 are supported by the core wire holders 21. The core wires 16 are held by the holding unit 28, immersed in the electroforming solution 18, and electroformed while supported by the core wire holder 21.

Figure 4:
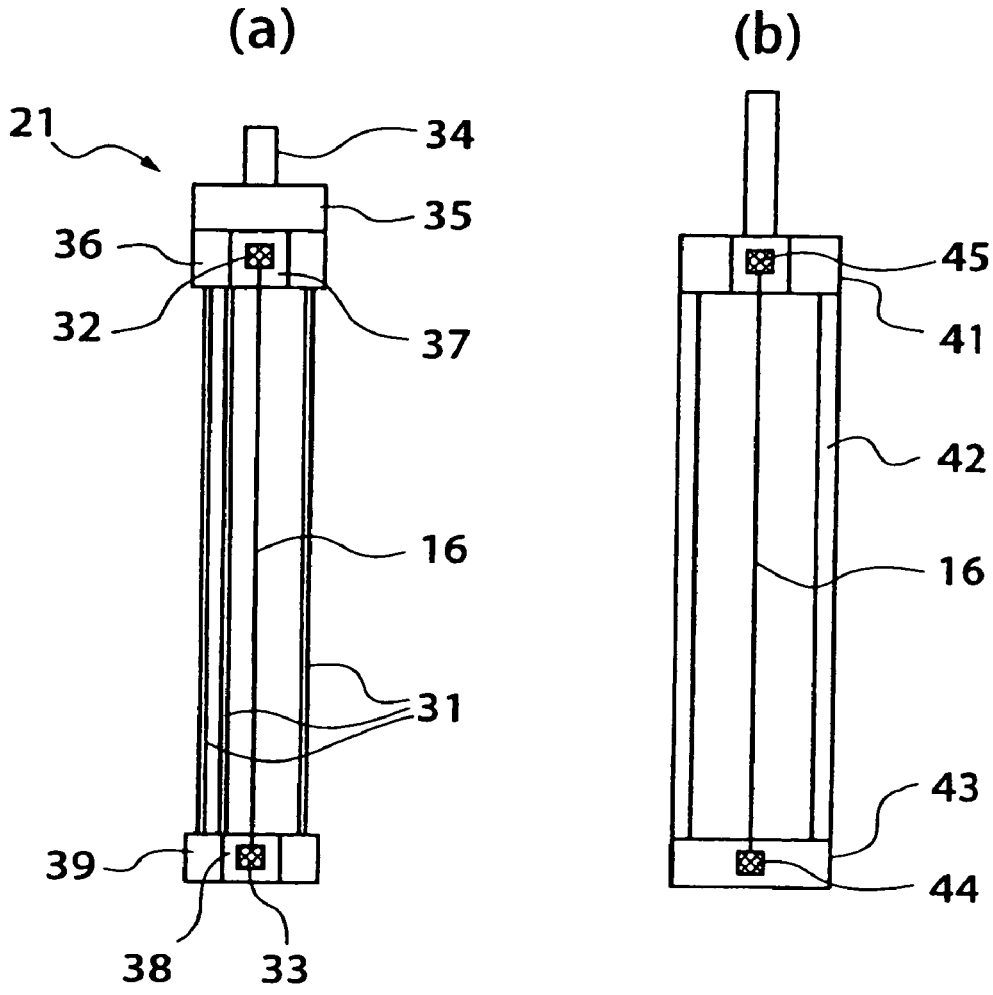
FIG. 4 is a drawing that shows an example of the core wire holder of the present invention.

Core wire holders 21 such as those shown in FIG. 4(*a*) and 4(*b*) may be used. In FIG. 4(*a*), three braces 31 are disposed between a lower frame 39 and upper frames 35 and 36 to maintain the overall shape. Portions of the upper frame 36 and lower frame 39 are provided with grooves 37 and 38, respectively; and the core wire 16 is secured in the core wire holder 21 by securing devices 32 and 33. There is also a pivot 34 through which the rotation from the motor 12 is transmitted to the core wire holder 21. In FIG. 4(*b*), the core wire holderconsists of an upper frame 41, a lower frame 43, and a transverse frame 42. The core wire 16 is secured by securing devices 44 and 45 at the upper frame 41 and the lower frame 43. It is apparent that the core wire holder is not restricted to these two configurations and may assume a variety of other appropriate forms.

A plurality of core wire holders 21 are held in, for example, a circular form by a holding unit. In FIG. 2, the holding unit 28 comprises an upper retaining frame 20, a lower retaining frame 25, a pivot 13, and an extension 22 thereof, and the core wire holders 21 are supported and held between the upper retaining frame 20 and the lower retaining frame 25. A device for rotating the core wire holders 21 is incorporated into the upper retaining frame 20. The pivot extension 22 is not necessarily required and is provided in order to stabilize the rotation of the holding unit 28. The end of the pivot extension is accommodated in the bearing 23 that is disposed on the bottom of the electroforming tank, aiding the stabilized rotation of the holding unit 28.

A plurality of individual core wire holders 21 is attached to the holding unit 28. It is preferable to attach as many core wires as possible. For example, 100 core wires can be attached to each holder in alignment with the periphery of the holding unit 28 arranged in a circle. The holding unit 28 is rotated by means of the motor 12 by the shaft 13 through the coupling 17. In addition, a device is incorporated into the area of the upper retaining frame 20 in order to individually rotate the core wire holders 21.

In FIG. 2, a plurality of ultrasonic generating devices 26 are disposed on the sides of the electroforming tank. This arrangement is designed to make the ion concentration in the electroforming tank uniform and to allow the ultrasonic generating devices to be moved as required.

Figure 5:
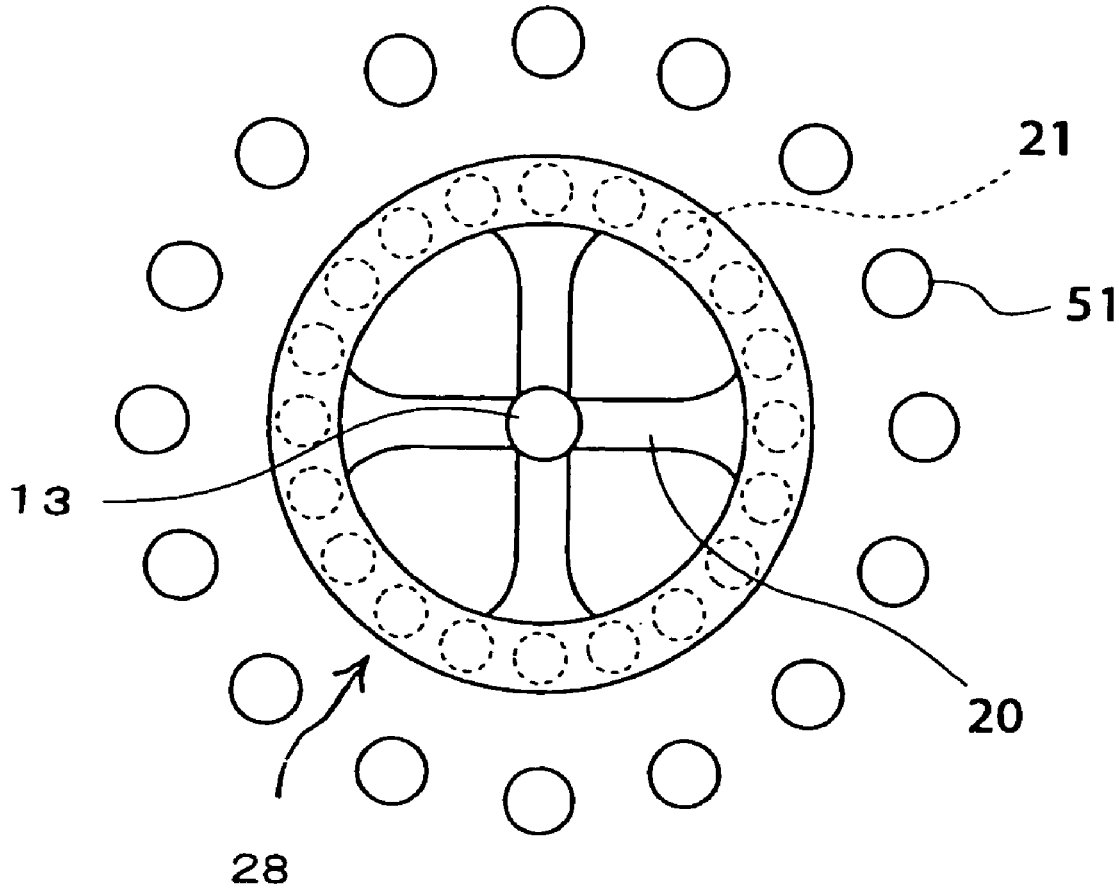
FIG. 5 is a drawing that shows an example of the arrangement of the core wire holders, the holding unit, and the jigs into which the metal is inserted of the present invention.

FIG. 5 is an outline drawing of the arrangement of the core wire holders 21, the holding unit 28, and the jigs 51 into which the metal is inserted. A plurality of core wire holders 21 are arranged and held in a circular form between the upper retaining frame 20 and the lower retaining frame (not shown in the drawing) of the holding unit 28. A plurality of jigs 51, into which the metal is inserted, are arranged in a circular form so as to encircle the holding unit 28. The rotation from the motor 12 rotates the core wire holders 21 through the device in the upper retaining frame 20 (not shown in the drawing) and, at the same time, rotates the holding unit 28.

Figure 3:
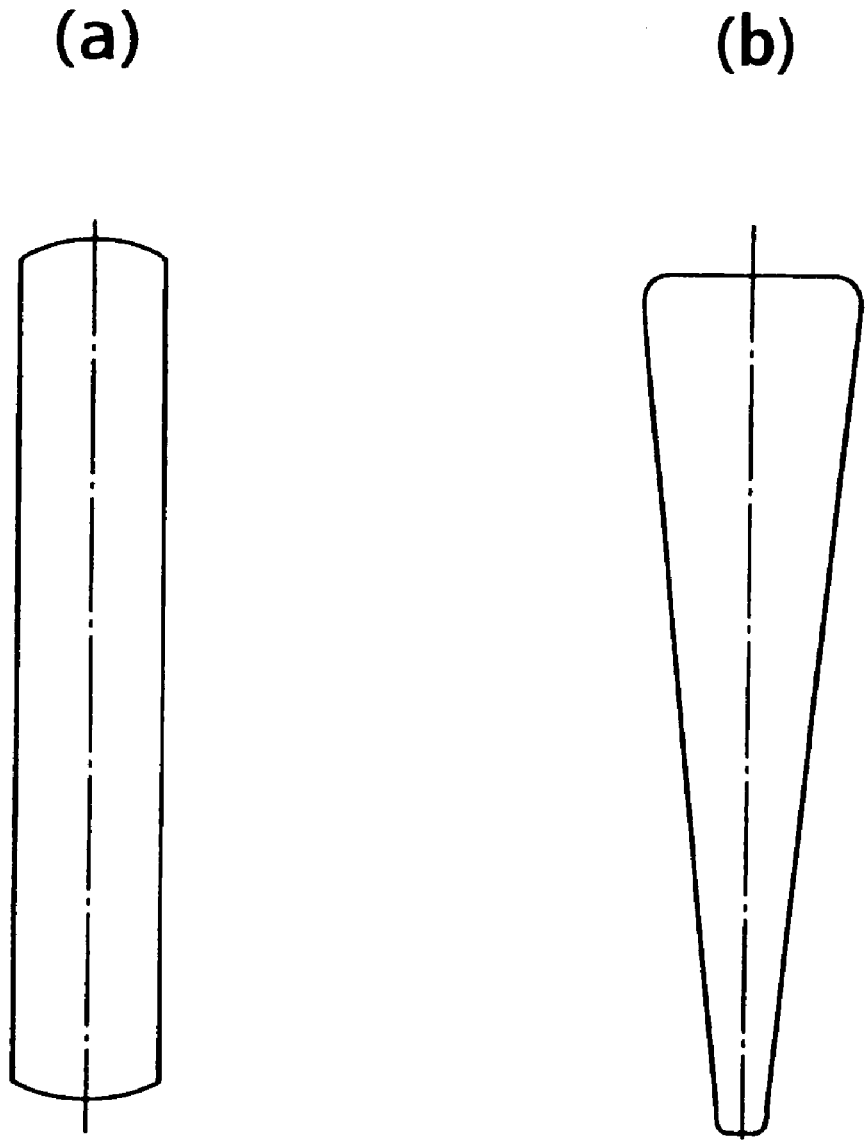
FIG. 3 is a drawing that shows the finished state of the electroforming.
Figure 6:
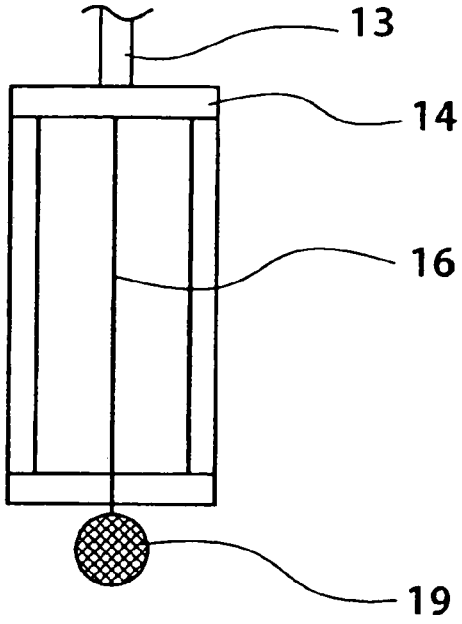
FIG. 6 is a drawing that shows an example of the core wires of the present invention having a disposed discharge body.

As was discussed before, inadequate uniformity results when long core wires are employed and a plurality of core wires are electroformed at one time. For example, as is shown in FIG. 3(*b*), a nonuniform electroforming is produced such that the outside diameter gradually becomes smaller from one end to the other end. The present inventors, as a result of a variety of research in order to solve this problem of the nonuniformity of the diameter, discovered that a ferrule having a uniform outside diameter could be obtained even when a long core wire is used by providing a conductive electric discharge body at the other end of the core wire. In other words, by the disposition of a discharge body at the other end of the core wire and the selection of an appropriate resistivity and surface area for the discharge body, it is established such that, in actuality, the current that flows to the core wire flows from the discharge body and that the current density in the longitudinal direction of the core wire becomes constant. As a result, the amount of electrodeposition running in the longitudinal direction of the core wires becomes uniform, and it is possible to obtain a ferrule having a uniform outside diameter. FIG. 6 shows a spherical discharge body 19 attached at the tip of the core wire 16.

It is preferable that the discharge body be made from a material that has comparatively low resistivity. This is in order to have the discharge of the current concentrated in the discharge body. A resistivity of $10\times10^{-6}$ Ωcm or less for the discharge body is preferred.

In addition, since the surface area of the discharge body performs an important function, it is necessary to determine the surface area of the discharge body with care. It is apparent that when a discharge body is disposed at the core wire and electroforming is carried out, electrodeposition will also occur on the discharge body. If, at this time, the surface area of the discharge body is great, the current density in the discharge body is increased, the amount of metal that is electrodeposited on the discharge body becomes large, and less metal is electrodeposited on the core wire in question. As a result, the time needed for the electroforming becomes extremely long.

Conversely, if the surface area of the discharge body is small, the uniformity of the current density of the core wire is insufficient, the amount of electrodeposition becomes nonuniform in the longitudinal direction of the core wire, and it is not possible to obtain an electroforming having a uniform outside diameter. Accordingly, in order to obtain an electroforming having a uniform outside diameter, it is important to set the surface area of the discharge body at an optimal value.

As one of the criteria for deriving the optimum surface area for the discharge body, it is preferable that the surface area be set at around 10 to 100 times the initial surface area of the core wire. The core wire has metal electrodeposited thereon by electroforming, and its diameter gradually increases. As the diameter of the core wire increases, the amount of metal electrodeposited on the core wire becomes greater than the amount of metal electrodeposited on the discharge body. In other words, initially, when the core wire is immersed in the electroforming solution and the electroforming is begun, the metal electrodeposited on the discharge body is relatively greater than on the core wire itself, but as the amount of metal electrodeposited on the core wire increases, the core wire takes precedence in terms of metal electrodeposition.

Figure 7:
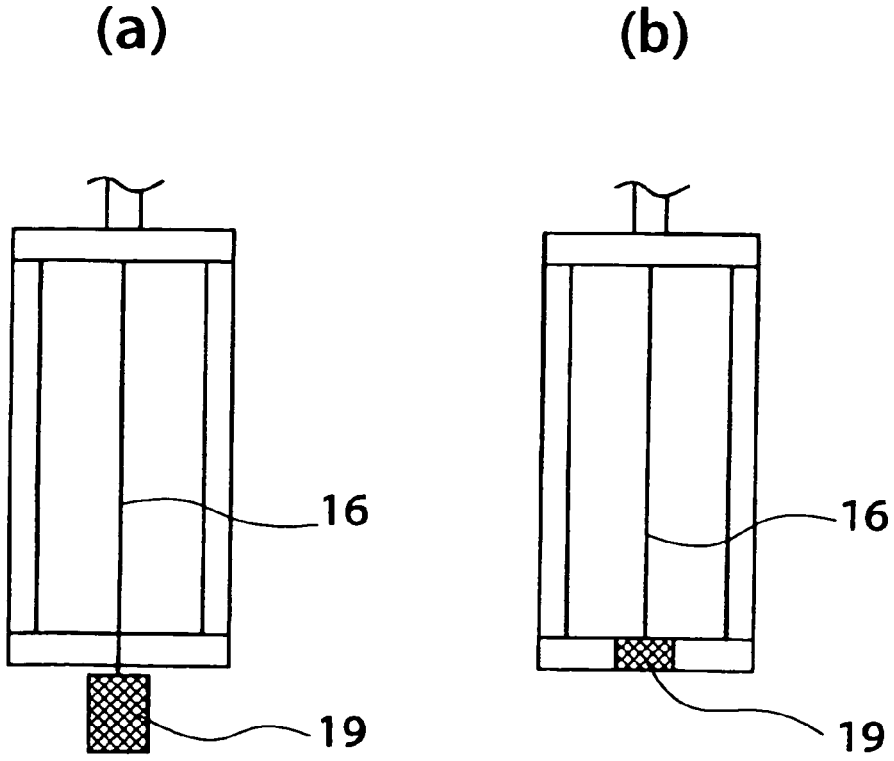
FIG. 7 is a drawing that shows another example of the discharge body of the present invention.

There are various possible forms for the electric discharge body 19. For example, it may be spherical as is shown in FIG. 6, or it may be plate-shaped as is shown in FIG. 7(*a*). In addition, as is shown in FIG. 7(*b*), the discharge body may be disposed below the support frame.

In addition, the present inventors focused their attention on the large effect the resistivity of the core wire has on the nonuniformity of the diameter and discovered that by using a metal that has a value for the resistivity that is less than a certain defined value for the core wire, a metal ferrule having a uniform outside diameter could be obtained even if a long core wire were used.

In other words, by making the resistivity of the core wire surface low, it is possible to obtain a metal ferrule having uniform dimensions. It is preferable that a resistivity for the core wire surface of $5\times10^{-6}$ Ωcm or less be selected. If the resistivity is greater than this value, it is difficult to obtain an electroforming with a uniform outside diameter when a long core wire is used and electroforming is performed. Gold, silver, copper, aluminum, and alloys having these as their primary component can be given as examples of substances that have a resistivity of $5\times10^{-6}$ Ωcm or less. In addition, since phosphor bronze has both a low resistivity and a high tensile strength, its use is ideal.

The core wire should preferably have a resistivity of $5\times10^{-6}$ Ωcm or less. For this reason, a core wire that has a resistivity of $5\times10^{-6}$ Ωcm or less as such may be used. It is also possible to use a product obtained by plating a low-resistivity metal such as stainless steel wire with a low-resistivity metal in the form of a thin layer which thickness is about 10 μm. In this case, the low-resistivity metal initially plated on the core wire as a thin layer is called the first metal, and the metal electroformed on the low-resistivity metal thus plated is called the second metal. By using these core wires and carrying out the electroforming, the amount of electrodeposition in the longitudinal direction of the core wire becomes uniform, making it possible to obtain a ferrule having a uniform outside diameter. The plated layer of the low resistivity first metal can have any thickness as long as a satisfactory electrical conductivity can be ensured and several micrometers to over 10 μm is appropriately applied. The second metal is electroformed onto the product until a specified diameter is reached.

The core wire may be a product in which stainless steel or phosphor bronze is selected as the base material for the matrix wire, and the surface thereof is plated with silver, gold, or copper to a thickness of around 10 μm. In addition, gold, silver, aluminum, copper, or an alloy having these as a primary component can be used as the base material. It is preferable that the surface of the core wire be a smooth surface but there are many cases where there are fine irregularities and there is also an advantage in that, by plating the surface with a low resistivity metal, the outer surface of the core wire will become smooth. In addition, since stainless steel wire, phosphor bronze wire, and the like have high tensile strength, these are advantageous for the pulling out of the core wire from the ferrules.

In order to provide the core wire holders with a stirring effect, it is preferable that wide braces be disposed on the wire holders. When the core wire holder is rotated, the wide braces are greatly affected by the resistance of the electroforming solution, and a stirring effect can be obtained. In basic terms, the shape of the braces, does not matter as long as it is something that can be affected by the resistance of the electroforming solution and is other than rectangular which is the basic shape. Examples include an arcuate or polygonal brace, and a shape with a serrated edge. The brace may also have irregularities or small holes. In order to increase the stirring effect, it is preferable that the braces project outward from the core wire holders. This is because when the core wire holder rotates, the electroforming solution resistance that affects the protruding portion becomes greater and the stirring effect is enhanced. It is also preferable that the braces be arranged in a radiating shape. This is because the rotation of the core wire holders allows the stirring effect to be further improved when the braces are arranged in a radiating shape.

In addition, it is preferable that the brace be a rectangular plate shape. This is because a rectangular plate is the most simple shape and has excellent stirring performance. The core wire holder of the present invention is characterized in that the braces are provided with a stirring effect. In addition to the fact that there are braces, it is necessary that the number of braces be two or more. It is preferable that the number of braces be two to four. This is because providing five or more braces still makes it unlikely there would be any improvement in the stirring effect.

Figure 8:
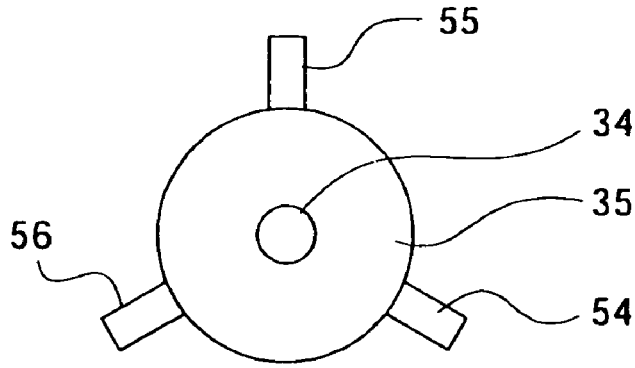
FIG. 8 is a drawing that shows an example of the core wire holders of the present invention that are equipped with wide braces.
Figure 8:
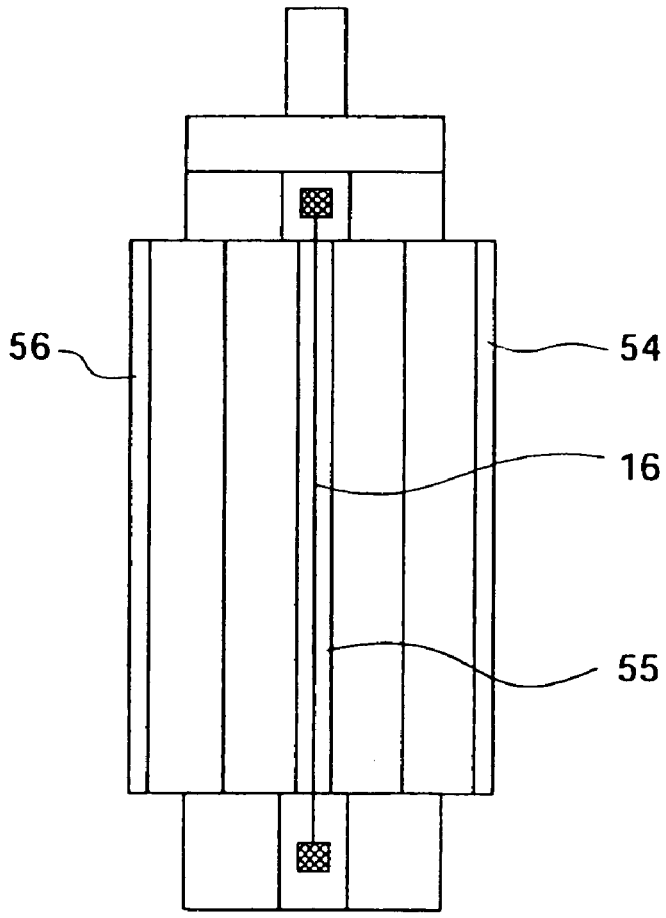

An example of the core wire holder braces is shown in FIG. 8. The braces are represented by the rectangular plate shaped braces 54, 55, and 56. The braces are arranged so that a portion projects outward from the core wire holder and, in addition, the braces are arranged in the radial direction of the core wire holder, that is to say, in a radiating shape. Adopting this kind of arrangement enhances the stirring effect achieved during the rotation of the core wire holder. The braces do not have to completely protrude outside the core wire holder and, beyond supporting the core wire holder, around 20 to 80% of its area may protrude to the outside. The brace is a rectangular shape in FIG. 8 but is not limited to that. For example, serrations may be provided to the protruding portion, or the plate may be provided with irregularities. In addition, at least two braces should be employed. From the viewpoint of the stirring effect, the use of around three braces is commonly preferred. Providing five or more braces fails to produce a marked increase in the stirring effect.

The tensile strength of the core wire is an important factor in terms of obtaining a uniform electroforming. In order to produce long electroformed products having a high degree of uniformity and superior circularity and coaxiality, it is necessary that a suitable amount of tensile force be applied to the core wire in the electroforming tank and that a tensioned state be established. A core wire holder equipped with an elastic mechanism may be used in order to apply suitable tension to the core wire. An elastic body such as a spring or rubber may be employed as the elastic mechanism. It is preferable that the size of the tensile force applied to the core wire be below the elastic limit to prevent permanent distortion. A tensile force that is around 10 to 50% of the elastic limit is especially preferable.

Figure 9:
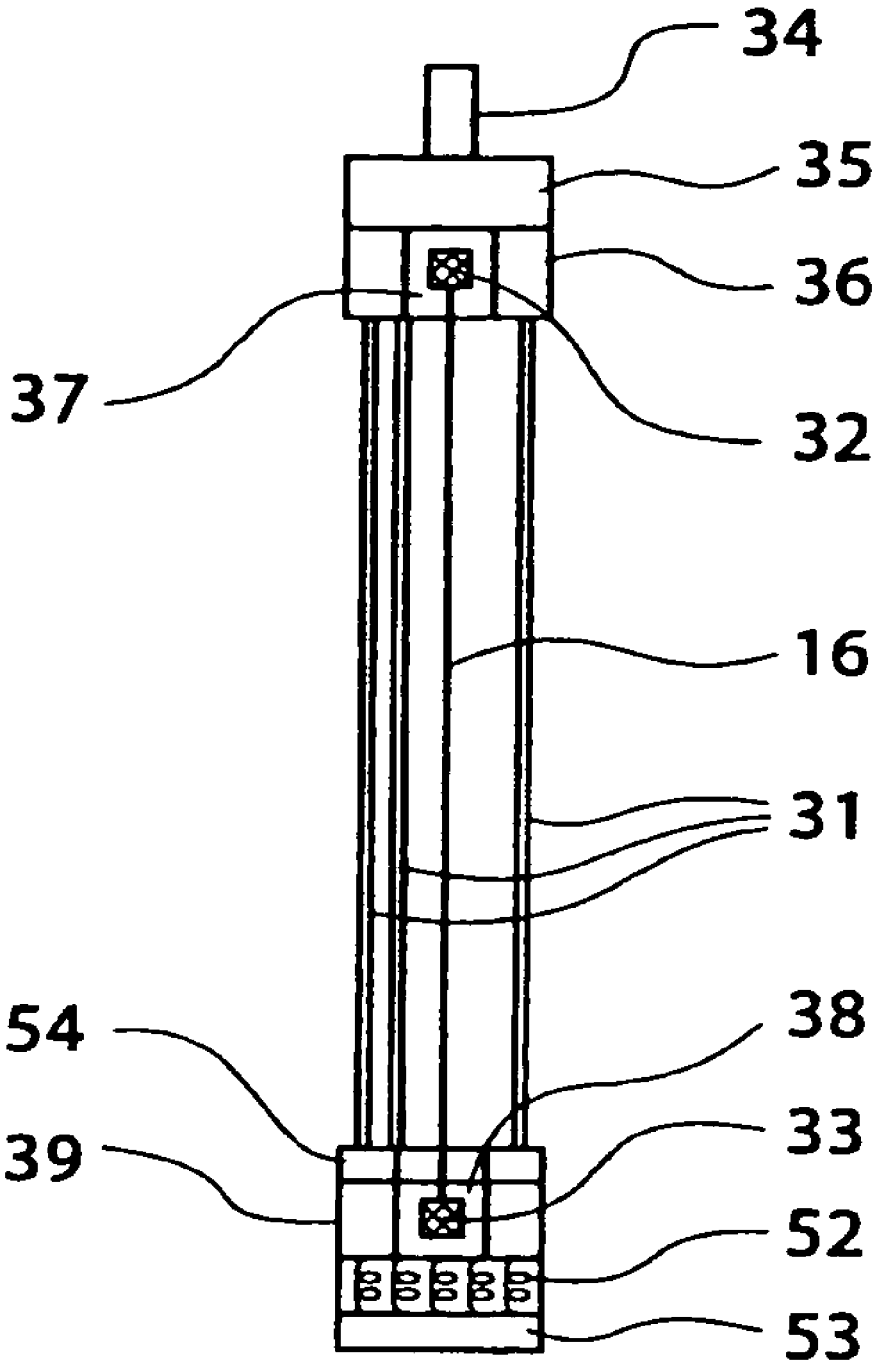
FIG. 9 is a drawing that shows an example of the core wire holders of the present invention that are equipped with an elastic mechanism.

An example of an elastic mechanism disposed on a core wire holder is shown in FIG. 9. The elastic mechanism 52 and the holder bottom frame 53, which grips the elastic mechanism, are disposed below the holder. One end of the elastic mechanism 52 is connected to the holder lower frame 39, and the other end of the elastic mechanism is connected to the holder bottom frame 53. The holder lower frame 39 moves up and down and controls the tensile force applied to the core wire.

Although the elastic mechanism 52 in FIG. 9 is a spring, this is not the only option, and rubber or another elastic body well known to those in the field may be employed. A spring having a specified tension can be selected and set in advance, and is thus suitable for use for electroforming. A spring with appropriate tension for the core wire may be selected depending on the core wire used. The tensile force applied to the core wire should be below the elastic limit of the core wire. If the elastic limit is exceeded, permanent distortion of the core wire is produced and a uniform electroforming cannot be obtained. Around 10 to 50% of the elastic limit is especially preferable for the tensile force applied to the core wire.

Figure 10:
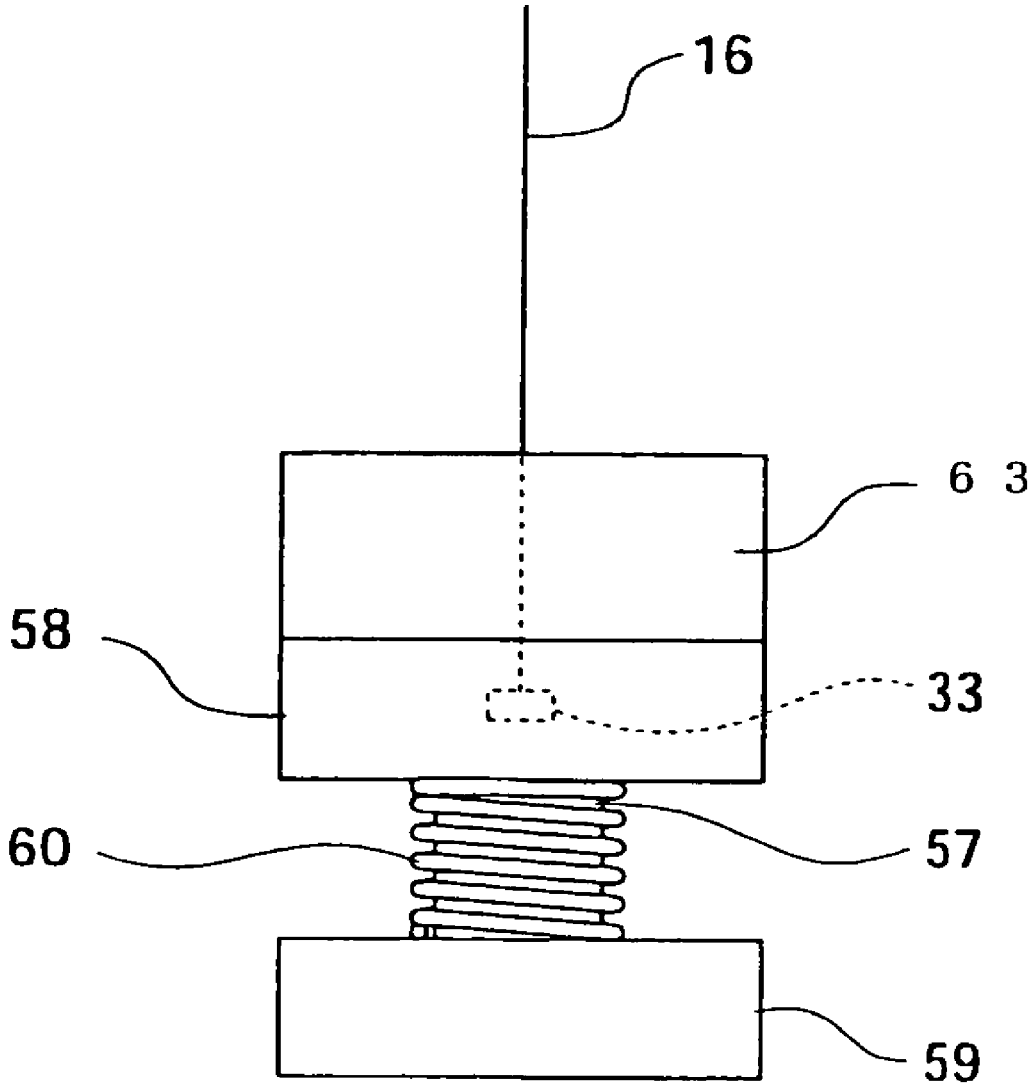
FIG. 10 is a drawing that shows another example of the core wire holders of the present invention that are equipped with an elastic mechanism.

Another example of an elastic mechanism is shown in FIG. 10. The core wire 16 is secured to the core wire holding section 58. The holder bottom frame 63 is linked to a spring holding section 59 by a cylindrical section 57. A spring 60 is wound around the cylindrical section 57. One end of the spring 60 is linked to the spring holding section 59, and the other end is linked to the core wire holding section 58. The core wire holding section 58 is allowed to move up and down along the cylindrical section 57. The core wire holding section 58 is pulled downward by the spring 60 and, as a result, tension is imparted to the core wire.

The shape of the porous metal tube into which the metal to be electroformed is inserted greatly affects the shape of the electroforming. In order to deal with this problem, the metal plate that is disposed is arranged so that it protrudes perpendicularly from the side of the porous metal tube in the longitudinal direction of the cylinder. This metal plate may be disposed so that it protrudes perpendicularly from the side of the porous metal tube in the longitudinal direction extending nearly the entire length of the cylinder. In addition, it is preferable that the metal plate be a fixed width. In particular, by forming a metal plate that extends nearly the entire length in the longitudinal direction of the porous metal tube and that has a fixed width such that it protrudes perpendicularly from the side of the cylinder, the current flows in concentrated fashion through the metal plate. Since the metal plate is vertical, the current flows uniformly in the longitudinal direction of the metal plate, yielding remarkable effects in the sense that the electroforming thus obtained has a uniform shape. As a result, the shape of the electroforming thus obtained will be uniform even if the shape of the porous metal tube is distorted.

It is preferable that the metal plate in the porous metal tube be placed facing in the direction of the core wire. Current flows between the metal plate of the porous metal tube and the core wire, and electroforming is carried out. Consequently, in order to obtain a uniform electroforming, it is preferable that the current flow from the metal plate of the porous metal tube toward the core wire. The porous metal tube should preferably remain unaffected by the electroforming solution and, from this standpoint, the use of a porous metal tube made of titanium is suitable.

Figure 11:
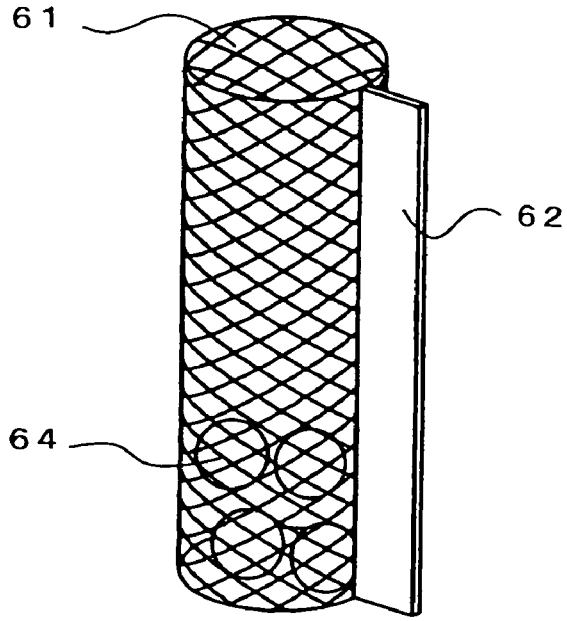
FIG. 11 is a drawing that shows the metal jigs of the present invention that are equipped metal plates.
Figure 12:
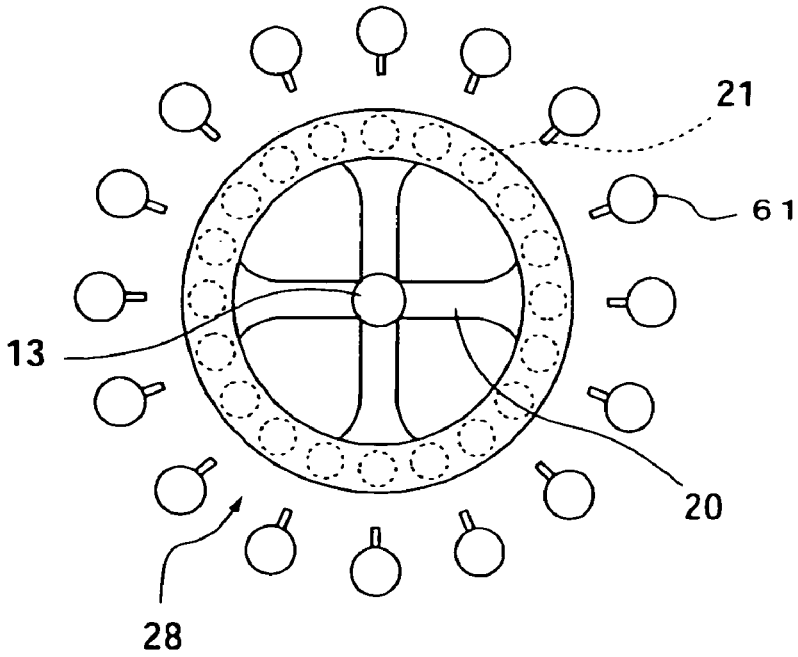
FIG. 12 is a drawing that shows the arrangement of the metal jigs of the present invention that are equipped with metal plates.
Figure 13:
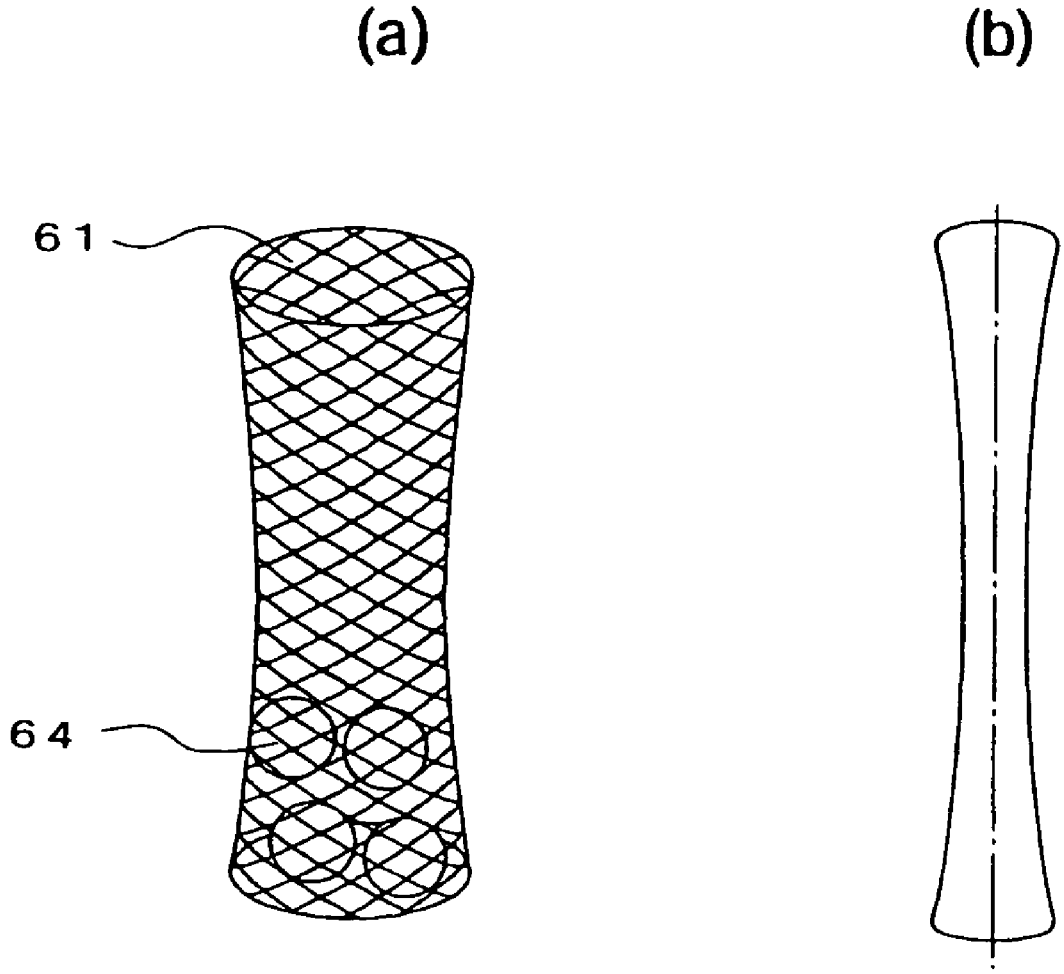
FIG. 13 is a drawing that shows an example of a metal jig and the resulting electroforming.

For example, a netlike tube made of metal as shown in FIG. 11 may be employed. In the porous metal tube 61, the metal plate 62 having a fixed width nearly over the entire length of the tube and extending in the longitudinal direction of the porous metal tube is disposed so that it protrudes perpendicularly from the side of the tube. The metal lumps 64 to be electroformed are inserted into the porous metal tubes 61. Netlike tubes made of metal can be used for the porous metal tubes, but this is not the only option, and any tubes made from a metal plate and provided with a plurality of holes may also be used.

With regard to the conditions for the electroforming operation, a ferrule grown to a diameter of around 3 mm is obtained by turning on the electricity for around one day with a DC current density of around 7 to 10 A/dm$^2$. The core wire 16 is removed by pulling out, extruding, dissolving in an acid or aqueous alkaline solution, or otherwise processing the wire used as the matrix. Whether the core wire 16 is pulled out or removed by some other method depends on the type of metal selected for the core wire 16. Based on the type of wire selected for the core wire 16, it can be decided to pull out, extrude, or dissolve the core wire in acid, an alkali, or the like.

The electroforming solution is determined in accordance with the target type of electroforming metal. Nickel or an alloy thereof, iron or an alloy thereof, copper or an alloy thereof, cobalt or an alloy thereof, a tungsten alloy, or another electroforming metal may be employed. Examples of electroforming solutions that can be used for these metals include solutions containing aqueous solutions of the following compounds as primary components: nickel sulfamate, nickel chloride, nickel sulfate, ferrous sulfamate, ferrous fluoroborate, copper pyrophosphate, copper sulfate, copper fluoroborate, copper silicofluoride, copper titanium fluoride, copper alkanol-sulfonate, cobalt sulfate, and sodium tungstate.

Among these, it is preferable to select nickel or an alloy having nickel as its primary component as the metal for the electroforming. In the particular case of nickel electroforming, an electroforming solution having nickel sulfamate as its primary component is suitable because of considerations related to the simplicity of the electroforming work, product hardness and other physical properties, chemical stability, ease of welding, and the like.

In addition, the electroforming liquid is passed through a filter having a filtering accuracy of around 0.1 to 2 μm at a high speed. This is heated with the temperature controlled in the range of ±5° C. of a suitable temperature, and organic impurities are occasionally removed using activated charcoal treatment. As required, metal impurities are removed with an anode of a corrugated sheet made of nickel plated iron and a cathode of carbon.

The anode is determined depending on the target electroforming metal and is selected from among nickel, iron, copper, cobalt, and the like. The form of the metal can be plate shaped or spherical as appropriate to its use. When spherical metal is used, it is placed in a basket made of titanium and covered with a bag made of a material that can tolerate the electroforming solution such as polyester.

Aluminum, copper, iron, alloys thereof, gold, silver, and other metals can be used as appropriate as the material for the wire used for the matrix. When the core wire is removed by pulling or extrusion, it is possible to use stainless steel wire, phosphor bronze wire, products obtained by treating the surfaces of these with other metals, or the like.

After a metal film has been formed by electroforming the surface of the core wire, and after the metal film has been cut to a specified dimension, the core wire is removed from the metal film, finishing is performed, and a ferrule is obtained. The core wire is removed by being pulled out. There is also a method in which the wire is dissolved and removed using a chemical, but dissolving a core wire having a small diameter is impractical. With regard to pulling out the core wire, after the metal film has been obtained by electroforming and cut to a specified dimension, the core wire end portion of one end of the metal film block is prodded with a jig, the core wire protrudes out from the other end of the metal film block, the portion of the core wire that protrudes is grasped, and the core wire is pulled out. At this time, the center portion of the core wire is prodded by a protuberance whose diameter is smaller than inside diameter of the core wire, and the core wire is pulled out by pulling the end of the core wire that appears at the surface of the opposite side.

EMBODIMENT 1

An explanation will be given below of the present invention based on embodiments. A phosphor bronze wire having a circular cross-section with a diameter of 0.126 mm and a length of 35 cm was mounted in the core wire holder 21. One hundred of the core wire holders were set in the holding unit 28 and immersed in the electroforming tank 18. The core wire holders were rotated at a speed of 60 rpm, and the holding unit was rotated at a speed of 30 rpm. The electroforming tank contained a solution having nickel sulfamate as the primary component thereof, and 50 anodes consisting of nickel balls in titanium nets inserted into polyester bags were set around the periphery of the holding unit. Electroforming was carried out under these conditions for ten hours at a cathode current density of around 9 A/dm$^2$. A nickel electroformed item with an average diameter of 2 mm was obtained. The electroforming was cut to a length of 12 mm with an automatic NC processing machine, and one of the ends was bored. The processed item was stood vertically such that the side that had not been bored faced upward, and a stamping machine was used to pound the item from above with a hammer having a protrusion whose diameter was smaller than the diameter of 0.126 mm of the core wire. The core wire was removed by pulling out the portion of the core wire that extended from the bottom of the processed item. The product was then finished. The resulting product did not have any effects and was within the prescribed specifications. In addition, a product that was within the prescribed specifications was obtained in the same manner when 30 kHz ultrasound was applied at a strength of 3 W/cm$^2$.

EMBODIMENT 2

Core wires made of stainless steel having a circular cross-section with a diameter of 0.126 mm and a length of 355 mm were set in a jig for electroforming as shown in FIG. 2. Then, as is shown in FIG. 6, a copper sphere with a surface area of 0.2 cm$^2$ was connected to the bottom of the core wire as a discharge body. In addition, metal plates of nickel were set in an electroforming tank having nickel sulfamate as its primary component. Then the core wires were immersed in the electroforming tank. Electroforming was carried out for 18 hours at a current density of around 10 A/dm$^2$ with the stainless steel core wires as the cathode and the nickel plates as the anode. Electroformings having an average diameter of about 2.5 mm were obtained. The electroformings had an outside diameter that was within a range of 2.5 mm±0.05 mm in the longitudinal direction, and the ferrules that were obtained from these were uniform and had satisfactory circularity and coaxiality.

EMBODIMENT 3

Wires made of stainless steel having a circular cross-section with a diameter of 0.126 mm and a length of 355 mm were plated with 10 μm of gold (resistivity, $2.05\times10^{-6}$ Ωcm), and 0.136-mm diameter core wires were obtained. The core wires were set in a jig for electroforming, as shown in FIG. 2. In addition, metal plates of nickel were set in an electroforming tank having nickel sulfamate as its primary component, and immersion in the electroforming tank was performed. Electroforming was carried out for 18 hours at a current density of around 10 A/dm$^2$, with the core wires as the cathode and the nickel plates as the anode. Nickel electroformed items having an average diameter of about 2.5 mm were obtained from the electroforming. The electroformed items had an outside diameter that was within a range of 2.5 mm±0.05 mm in the longitudinal direction, and uniform electroformed items were obtained. In addition, the ferrules that were obtained from the electroformed items had satisfactory circularity and coaxiality.

EMBODIMENT 4

Core wires made of phosphor bronze having a circular cross-section with a diameter of 0.126 mm and a length of 355 mm were set in a jig for electroforming, as shown in FIG. 2. In addition, netlike porous metal tubes made of titanium into which nickel metal lumps had been inserted were set in an electroforming tank having nickel sulfamate as its primary component. The porous metal tubes were equipped with metal plates 62 that spanned nearly the entire length of the tubes, as shown in FIG. 11. In addition, the metal plates 62 were set so that they faced in the direction of the axis of rotation of the holding unit 28. Core wires 16 were immersed in the electroforming solution, each in its holder 21. One hundred of wires were arranged in a circle. The porous metal tubes were set so that the metal plates faced in the direction of the axis of rotation of the holding unit 28. Electroforming was carried out for 18 hours at a current density of around 10 A/dm$^2$, with the core wires as the cathode and the porous metal tubes containing nickel lumps as the anode. Nickel electroformings having an average diameter of about 2.5 mm were obtained from the electroforming. The electroformings had an outside diameter that was within a range of 2.5 mm±0.05 mm in the longitudinal direction, and uniform electroformings were obtained. In addition, the ferrules that were obtained from the electroformed items had satisfactory circularity and coaxiality.

EMBODIMENT 5

Core wires made of phosphor bronze having a circular cross-section with a diameter of 0.126 mm and a length of 355 mm were set in the core wire holder shown in FIG. 8 and immersed in an electroforming device 10 (FIG. 2). In addition, netlike porous metal tubes made of titanium into which nickel metal lumps had been inserted were set in an electroforming tank having nickel sulfamate as its primary component. Then, the core wires 16 were immersed in the electroforming tank, each in its holder 21. One hundred of the core wires were arranged in a circle. The porous metal tubes were set so that the metal plates faced in the direction of the axis of rotation of the holding unit 28. Electroforming was carried out for 18 hours at a current density of around 10 A/dm$^2$, with the core wires as the cathode and the porous metal tubes containing nickel lumps as the anode. Nickel electroformings having an average diameter of about 2.5 mm were obtained from the electroforming. The electroformings had an outside diameter that was within a range of 2.5 mm±0.05 mm in the longitudinal direction, and uniform electroformings were obtained. In addition, the ferrules that were obtained from the electroformed items had satisfactory circularity and coaxiality.

EMBODIMENT 6

Core wires made of phosphor bronze having a circular cross-section with a diameter of 0.126 mm and a length of 355 mm were set in the core wire holder shown in FIG. 9 and immersed in the electroforming device 10. The spring on the holder was set to a load of 0.15 N. In addition, netlike porous metal tubes made of titanium into which nickel metal lumps had been inserted were set in an electroforming tank having nickel sulfamate as its primary component. The core wires 16 were then immersed in the electroforming tank, each in its holders 21. One hundred of the core wires were arranged in a circle. The porous metal tubes were set so that the metal plates faced in the direction of the axis of rotation of the holding unit 28. Electroforming was carried out for 18 hours at a current density of around 10 A/dm$^2$, with the core wires as the cathode and the porous metal tubes containing nickel lumps as the anode. Nickel electroformings having an average diameter of about 2.5 mm were obtained from the electroforming. The electroformings had an outside diameter that was within a range of 2.5 mm±0.05 mm in the longitudinal direction, and uniform electroformings were obtained. In addition, the ferrules that were obtained from the electroformed items had satisfactory circularity and coaxiality.

COMPARATIVE EXAMPLE

Electroforming was carried out in the same manner as in the embodiments except that a stainless steel wire (resistivity: $90\times10^{-6}$ Ωcm) with a diameter of 0.126 mm and a length of 355 mm was used as the core wire. The upper portion of the resulting electroformed item had a large diameter, and the lower portion had a small diameter. That is to say, the diameter of the upper portion was around 2.77 mm, and the diameter of the lower portion was around 2.42 mm. It was thus learned that nonuniform electroformed items alone could be obtained when a core wire made of stainless steel was used and there was no discharge body at the tip of the core wire.

INDUSTRIAL APPLICABILITY

When electroforming is carried out with a plurality of long core wires, it is possible to produce metal ferrules having uniform outside diameters and a high degree of circularity with high productivity and coaxiality by adopting an arrangement in which the core wires in the electroforming solution are individually rotated in their core wire holders, and the holding unit for holding the plurality of core wire holders is also rotated.

The ferrule production carried out in accordance with the present invention does not require expensive molding equipment or molds and can be implemented as long as inexpensive electroforming equipment is available. In addition, the energy cost is low since there is no step in which firing is carried out at a high temperature. Furthermore, the dimensions of the products are accurate to the extent that no classification or separation according to dimensional measurements is needed since the electroforming has extremely high dimensional transfer accuracy.

The increasing diversification and versatility of optoelectronic communications has recently created a need for extremely thin ferrules designed for use with optical fibers and provided with an outside diameter of 2.5 mm or less, in particular, 1.25 mm, 0.9 mm, 0.75 mm, etc. The ferrules can not be produced from zirconia or the like to an outside diameter of 1.25 mm or less. The metal ferrules manufactured by the production method and apparatus in accordance with the present invention can be rendered extremely thin and endowed with exceptional processability.

The invention claimed is:

1. A method of producing metal ferrules comprising:

electroforming a metal film on the outer surface of a core wire;

pulling the core wire out of the metal film electroformed thereon;

holding with a holding unit a plurality of core wire holders each of which holds a core wire and which are arranged circumferentially on the holding units;

providing a plurality of jigs which accommodate the metal used for electroforming in the periphery of the holding unit; and performing electroforming while rotating the core wire holders simultaneously with rotating the holding unit.

2. The method of producing metal ferrules according to claim 1, wherein the electroforming is performed using core wires which have a resistivity of $5\times10^{-6}$ Ωcm or less.

3. The method of producing metal ferrules according to claim 1, wherein a thin layer of a first metal having a resistivity of $5\times10^{-6}$ Ωcm or less is plated on core wires made of stainless steel or phosphor bronze, and a second metal is electroformed thereon until a specified diameter is obtained.

4. The method of producing metal ferrules according to claim 3, wherein the first metal is any one of gold, silver, copper, aluminum, and alloys having these metals as the primary component thereof, and the second metal is nickel or an alloy having nickel as the primary component thereof.

5. The method of producing metal ferrules according to claim 1, wherein the electroforming is carried out with a conductive electric discharge body held at one end of the core wire which is further from the power source than the other end of the core wire.

6. The method of producing metal ferrules according to claim 5, wherein the resistivity of the conductive electric discharge body is $10\times10^{-6}$ Ωcm or less.

7. The method of producing metal ferrules according to claim 5, wherein the surface area of the conductive electric discharge body is 10 to 100 times an outer surface area of the core wire.

8. The method of producing metal ferrules according to claim 1, wherein the core wire is made of stainless steel or phosphor bronze, and wherein the metal to be electroformed is nickel or an alloy having nickel as the primary component thereof.

9. The method of producing metal ferrules according to claim 1, wherein the core wire holder is provided with an elastic mechanism for applying tension to the core wire.

10. The method of producing metal ferrules according to claim 9, wherein the tensile force which is transmitted to the core wire by the elastic mechanism is less than the elastic limit of the core wire.

11. The method of producing metal ferrules according to claim 1, wherein the jig in which the metal to be electroformed is accommodated is provided with a metal plate having a fixed width nearly over an entire length of the jig and extending in the longitudinal direction of the jig such that the metal plate protrudes perpendicularly from a side of the jig toward the core wire.

12. The method of producing metal ferrules according to claim 11, wherein the jig is a netlike tube made of titanium.

13. The method of producing metal ferrules according to claim 1, wherein the core wire holder is provided with wide braces which project outward from the holder.

14. The method of producing metal ferrules according to claim 13, wherein the braces are arranged in a radial pattern.

15. The method of producing metal ferrules according to claim 13, wherein the braces are rectangular plates.

16. The method of producing metal ferrules according to claim 13, wherein the number of braces is two to four.

17. An electroforming apparatus for producing metal ferrules comprising:

a holding unit having a plurality of core wire holders each of which holds a core wire and which are arranged circumferentially on the holding unit such that the core wire is attached to the holding unit through a respective one of the core wire holders, wherein the holding unit and the core wire holders are rotatable such that the holding unit is rotated while the core wire holders are rotated; and a plurality of jigs which accommodate the metal to be electroformed provided in the periphery of the holding unit.

18. The apparatus for producing metal ferrules according to claim 17, wherein the jigs into which the metal to be electroformed is inserted are arranged circumferentially on the periphery of the core wire holders.

19. The apparatus for producing metal ferrules according to claim 17, wherein the electroforming tank is provided with an ultrasonic generating system for agitating the electroforming solution.

20. The apparatus for producing metal ferrules according to claim 17, further comprising a conductive electric discharge body at one end of the core wire which is further from the power source than the other end of the core wire.

21. The apparatus for producing metal ferrules according to claim 20, wherein the resistivity of the conductive electric discharge body is $10\times10^{-6}$ Ωcm or less.

22. The apparatus for producing metal ferrules according to claim 20, wherein a surface area of the conductive electric discharge body is 10 to 100 times an outer surface area of the core wire.

23. The apparatus for producing metal ferrules according to claim 17, wherein the core wires have a resistivity of $5\times10^{-6}$ Ωcm or less.

24. The apparatus for producing metal ferrules according to claim 17, wherein the core wires are plated with a thin layer of a metal that has a resistivity of $5\times10^{-6}$ Ωcm or less.

25. The apparatus for producing metal ferrules according to claim 17, wherein the core wire holder is provided with an elastic mechanism for applying tension to the core wire, and wherein the tensile force that is transmitted to the core wire by the elastic mechanism is less than the elastic limit of the core wire.

26. The apparatus for producing metal ferrules according to claim 17, wherein the jig in which the metal to be electroformed is accommodated is provided with a metal plate having a fixed width nearly over an entire length of the jig and extending in the longitudinal direction of the jig such that the metal plate protrudes perpendicularly from a side of the jig facing toward the core wire.

27. The apparatus for producing metal ferrules according to claim 26, wherein the jig is a netlike tube made of titanium.

28. The apparatus for producing metal ferrules according to claim 17, wherein the core wire holder is provided with wide braces which project outward from the holder.

29. The apparatus for producing metal ferrules according to claim 28, wherein the braces are arranged in a radial pattern.

30. The apparatus for producing metal ferrules according to claim 28, wherein the braces are rectangular plates.

31. The apparatus for producing metal ferrules according to claim 28, wherein the number of braces is two to four.

32. The method of producing metal ferrules according to claim 9, wherein the elastic mechanism is a spring or rubber.

33. The apparatus for producing metal ferrules according to claim 25, wherein the elastic mechanism is a spring or rubber.

* * * * *

UNITED STATES PATENT AND TRADEMARK OFFICE

CERTIFICATE OF CORRECTION

PATENT NO. : 7,090,761 B2
APPLICATION NO. : 10/169253
DATED : August 15, 2006
INVENTOR(S) : Tanaka et al.

It is certified that error appears in the above-identified patent and that said Letters Patent is hereby corrected as shown below:

Front Page of Patent

Delete "(30) Foreign Application Priority Data

Dec. 28, 1999 (JP) 11-373354
Dec. 28, 1999 (JP) 11-373665
Dec. 28, 1999 (JP) 11-375242"" and insert --(30) Foreign Application Priority Data Dec. 28, 1999 (JP) 11-373354
Dec. 28, 1999 (JP) 11-373665
Dec. 28, 1999 (JP) 11-375242
Jan. 27, 2000 (JP) 2000-18426
Jan. 27, 2000 (JP) 2000-18579
Jan. 28, 2000 (JP) 2000-20746--.

Signed and Sealed this

Twenty-eighth Day of November, 2006

JON W. DUDAS
*Director of the United States Patent and Trademark Office*